US005140827A

United States Patent [19]

Reedy

[11] Patent Number: 5,140,827

[45] Date of Patent: Aug. 25, 1992

[54] AUTOMATIC REFRIGERANT CHARGE VARIATION MEANS

[75] Inventor: Wayne R. Reedy, Edwardsville, Ill.

[73] Assignee: Electric Power Research Institute, Inc., Palo Alto, Calif.

[21] Appl. No.: 699,918

[22] Filed: May 14, 1991

[51] Int. Cl.[5] ..... F25B 41/00

[52] U.S. Cl. ..... 62/174; 62/324.4

[58] Field of Search ..... 62/174, 324.4

[56] References Cited

U.S. PATENT DOCUMENTS

| | | | |
|---|---|---|---|
| 3,238,737 | 3/1966 | Shrader et al. | 62/174 |
| 4,299,098 | 11/1981 | DeRosier | 62/160 |
| 4,528,822 | 7/1985 | Glamm | 62/324.6 |
| 4,765,149 | 8/1988 | Shiga et al. . | |
| 4,893,476 | 1/1990 | Bos et al. | 62/79 |

*Primary Examiner*—William E. Wayner
*Attorney, Agent, or Firm*—Wall and Roehrig

[57] ABSTRACT

A heat pump system that includes a compressor, an outdoor heat exchanger and an indoor heat exchanger is provided with automatic refrigerant charge adjustment. A refrigerant reservoir has an inlet branch coupled to a liquid refrigerant line between the two heat exchangers and a discharge branch that is coupled to the suction line that feeds low pressure vapor to the compressor. Solenoid valves on the two branches are controlled by a thermostat that is in thermal contact with the discharge line from the compressor. If the discharge temperature is low, refrigerant liquid is transferred to the reservoir. If the discharge temperature is high, the refrigerant is injected into the suction gas.

6 Claims, 2 Drawing Sheets

AUTOMATIC REFRIGERANT CHARGE VARIATION MEANS

BACKGROUND OF THE INVENTION

This invention relates to combined heat pump and hot water systems that provide heating of an indoor air space, or cooling of the indoor air space, and in which the amount of refrigerant, i.e., the charge of the system, is automatically adjusted based on thermal demand.

Integrated heat pump systems of this type have a compressor and indoor and outdoor heat exchanger coils, and in many cases, an integral water heat exchanger. Compressed refrigerant flows through the water heat exchanger and gives up superheat to water in the heat exchanger. Then the compressed refrigerant vapor flows via a reversing valve to either the indoor coil (for heating mode) or to the outdoor coil (for cooling mode). There the refrigerant is condensed and liquid refrigerant proceeds through a condensed refrigerant line to the other of the heat exchanger coils, where it passes through an expansion device into the coil, and the condensed refrigerant evaporates and picks up heat. Hot water is provided in either a cooling mode or heating mode.

Where neither space heating nor cooling is called for, the system can still provide water heating and the water heat exchanger rejects the bulk of the refrigerant heat into the water. In that case the heat exchanger fan associated with the condenser coil is kept off, but that of the evaporator coil is actuated on. For example, when the reversing valve is set for a heating mode, but space heating is not called for, the indoor fan is not run. On the other hand, when the reversing valve is set for cooling, but cooling is not called for, the outdoor fan is not run. Superheat and condensing heat are rejected into the water.

Air conditioning and heating (i.e. air-to-air) heat pumps must operate over a wide range of conditions, and have expansion device characteristics and refrigerant charge levels selected to optimize the balance between performance and reliability over this range. If there is a high refrigerant charge provided, the system will operate more effectively under high demand conditions, but may flood the system in times of low demand, and, vice versa, if less charge is provided performance suffers during times of high demand. To provide sufficient refrigerant charge over the entire range of conditions without overcharging the system during times of lower demand, some means to adjust the refrigerant charge level of the heat pump system should be incorporated. However, no suitable charge adjustment mechanism has been previously provided.

Bos et al. U.S. Pat. No. 4,893,476 employs a liquid storage receiver to store unneeded refrigerant in a heat pump system. However, this arrangement relies on rather expensive thermal expansion valves to meter the circulating flow.

Derosier U.S. Pat. No. 4,299,098 includes a refrigerant charge control in a space heating, cooling, and water heating heat pump system to keep the refrigerant from becoming trapped within an inactive heat exchange means. During times of heavy load excess refrigerant is directed into the inactive heat exchange means by actuating a number of four-way valves.

Glamm U.S. Pat. No. 4,528,822 employs a charge reservoir to store refrigerant charge, and controls charge by removing charge to the reservoir in some modes but returns the charge from the reservoir in other modes of operation. Valves to the reservoir open or close depending only on the mode of operation rather than on the refrigerant pressure or temperature at the compressor.

OBJECTS AND SUMMARY OF THE INVENTION

It is accordingly an object of this invention to provide a heat pump system with means to adjust the active refrigerant charge therein so as to improve performance in any of its modes over a range of operating conditions.

It is a more specific object to provide a refrigerant charge adjustment means which is straightforward and relatively simple and inexpensive to implement, while at the same time is highly reliable.

In accordance with any of several preferred embodiments of this invention, a heat pump system is provided with a charge adjustment arrangement that changes the amount of active refrigerant charge in the system in response to changes in the operating conditions, i.e., changes in load, of the heat pump system. The charge adjustment arrangement can favorably include a refrigerant reservoir or tank, a first branch circuit connected between the reservoir and the condensed refrigerant line, and a second branch circuit connected between the reservoir and the suction line that feeds evaporated refrigerant to the suction ports of the compressor. Each branch circuit includes an actuable valve, such as a solenoid valve or a pressure controlled valve in series with a flow restrictor such as a capillary tube.

A sensor device or devices, e.g. a thermostat, is positioned on the pressure line at the discharge port of the compressor, and senses the discharge temperature of the compressed refrigerant. Alternatively, the discharge pressure could be sensed. A circuit couples the sensor devices to the first and second actuable valves for selectively admitting condensed refrigerant into the reservoir or discharging it into the suction line depending on the discharge temperature of refrigerant leaving the compressor. Below one temperature, refrigerant is transferred to the reservoir but above a second temperature refrigerant is injected back from the reservoir into the active system.

The temperatures at which the actuable valves are opened can depend on the heat pump operating mode, i.e., a first set of temperature levels for space heating, a second set of temperature levels for cooling, and a third set of temperatures for water heating only without space heating or cooling (i.e. dedicated water heating).

A "smart" controller can be employed which automatically adjusts the threshold temperature levels for actuation based on additional factors such as outdoor temperature, indoor air temperature, coil temperature, relative humidity, suction pressure, and so forth.

The above and many other objects, features and advantages of this invention will be more fully understood from the ensuing description of selected preferred embodiments, which should be read in connection with the accompanying Drawing.

DETAILED DESCRIPTION OF THE PREFERRED EMBODIMENT

Figure 1:
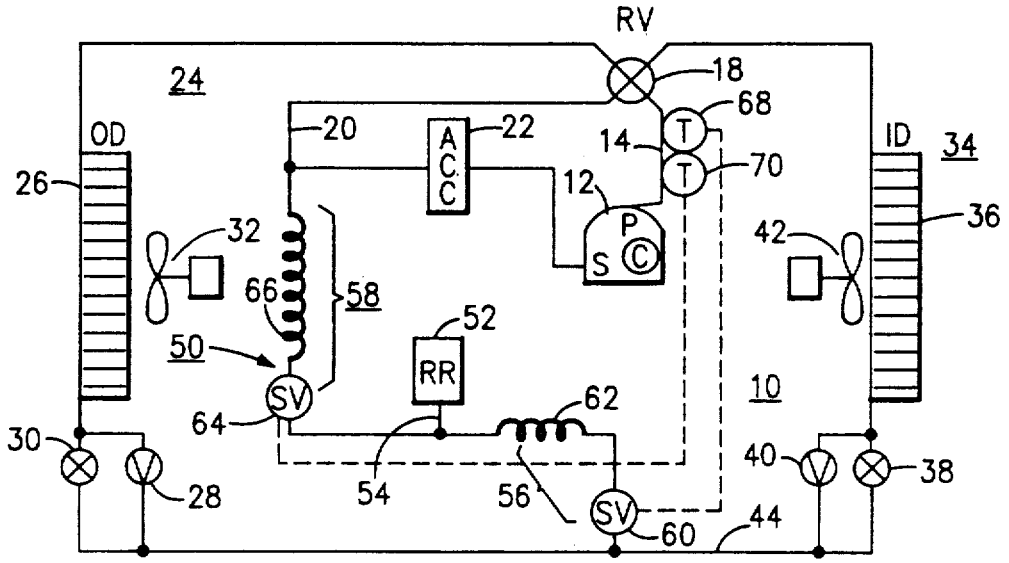
FIG. 1 is a schematic flow circuit diagram of a heat pump system according to an embodiment of this invention.

With reference initially to FIG. 1 of the Drawing, a heat pump system 10 includes a refrigerant compressor 12 of suitable design capable of pumping a refrigerant fluid at a desired operating temperature and pressure. The compressor 12 receives low pressure vapor at a suction port S and discharges compressed refrigerant at a discharge or pressure port P. The latter supplies hot compressed refrigerant through a discharge line 14 to a four-way reversing valve 18. The reversing valve has four connections or ports, one of which is connected to the discharge line 14 and another of which is connected through a suction line 20 to the suction port S of the compressor 12. An accumulator or dryer 22 is interposed ahead of the compressor 12 to intercept liquid or moisture that might be present in the refrigerant fluid in the suction line 20.

The other two ports of the reversing valve 18 connect respectively to an outdoor heat exchanger 24 and an indoor heat exchanger 34, described in greater detail below. The reversing valve 18 has a cooling or air conditioning position and a heating position. In the cooling position, the outdoor heat exchanger serves as the condenser while the indoor heat exchanger serves as evaporator. In the heating position, the indoor heat exchanger 34 serves as the condenser while the outdoor heat exchanger 24 serves as the evaporator. The reversing valve 18 can be of any of a number of known designs.

The outdoor heat exchanger 24 comprises an outdoor evaporator/condenser coil 26 that is connected at one end to the reversing valve 18 and at the other end to a check valve 28 and an expansion device 30 in parallel with one another. An outdoor fan 32 forces outdoor air over the heat exchanger coil 26 for transfer of heat between the refrigerant and the outdoor air.

An indoor heat exchanger 34 comprises an indoor evaporator/condenser coil 36 that is connected at one end to the reversing valve 18 and at the other end to a check valve 38 and expansion device 40 in parallel. An indoor fan 42 forces air from the indoor comfort or living space over the coil 36, for transfer of heat between the indoor air and the refrigerant in the coil 36.

A condensed refrigerant line or liquid line 44 connects the two heat exchangers 24 and 34. In the heating mode, condensed refrigerant flows from the indoor coil 36, through the check valve 38 and liquid line 44, and then through the expansion device 30 into the outdoor heat exchanger coil 26. When the reversing valve 18 is set to place the system 10 into a cooling mode, the condensed refrigerant flows from the outdoor coil 26, through the check valve 28 and liquid line 44, and then through the expansion device 40 into the indoor heat exchanger coil 36.

A refrigerant charge adjustment arrangement 50 is provided for automatically adding refrigerant to or removing refrigerant from the active heat pump elements depending on the operating environment, in this case depending on the temperature of the compressed refrigerant gas that is leaving the discharge port P of the compressor 12. As implemented in the embodiment of FIG. 1, the arrangement 50 includes a refrigerant reservoir 52 having an inlet/outlet port 54 disposed on a lower end, an inlet branch 56 connecting the reservoir port 54 to the liquid refrigerant line 44 and a discharge branch 58 connecting the reservoir port 54 to the suction line 20. The inlet branch 56 comprises a solenoid valve 60 or equivalent valve in series with a flow restrictor 62 such as a capillary tube. The discharge branch 58 also comprises a solenoid valve 64 or equivalent valve in series with a flow restrictor 66 such as a capillary tube. First and second thermostats 68 and 70 are disposed in thermal contact with the discharge compressed refrigerant gas in the line 14, for actuating the solenoid valve 62 and 64, respectively, via control lines shown here as dotted lines. The two thermostats 68, 70 are sensitive to respective temperatures $T_1$ and $T_2$. Thermostat 68 opens the valve 60 when the discharge temperature is below temperature $T_1$, and thermostat 70 opens the valve 64 when the discharge temperature exceeds temperature $T_2$.

If the compressor discharge temperature drops below temperature $T_1$ of, for example, 170° F., the solenoid valve 60 opens to admit a small flow of liquid refrigerant into the reservoir 52. The rate of flow is controlled by the capillary tube or similar restrictor 62. This means some condensed refrigerant is subtracted from the flow in the line 44. The removal of a small amount of refrigerant from the operating system reduces the subcooling of the liquid refrigerant. For a typical heat pump system the expansion devices 30 or 40, which can be fixed or variable orifices, or in some cases a capillary, are sensitive to inlet subcooling. The result of removal of some of the refrigerant to the reservoir 52 is to reduce the total system refrigerant flow rate. This, in turn, increases the refrigerant superheat for the vapor leaving the evaporator coil and entering the compressor 12. This consequently increases the compressor discharge temperature.

When the compressor discharge temperature increases to a level above temperature $T_1$, the solenoid 60 shuts off and stops the transfer of refrigerant to the reservoir 52.

On the other hand, if the discharge refrigerant becomes hotter than the thermostat temperature $T_2$, for example 190° F., the solenoid valve 64 opens, and permits a small flow of refrigerant, as modulated by the flow restrictor 66, out from the reservoir 52, which is at an intermediate pressure, into the suction line 20 which is at low pressure. This adds to the operating system charge, thus increasing subcooling, reducing superheat, and consequently reducing the compressor discharge temperature. When the discharge temperature drops below temperatures $T_2$, the solenoid valve 64 closes.

Figure 2:
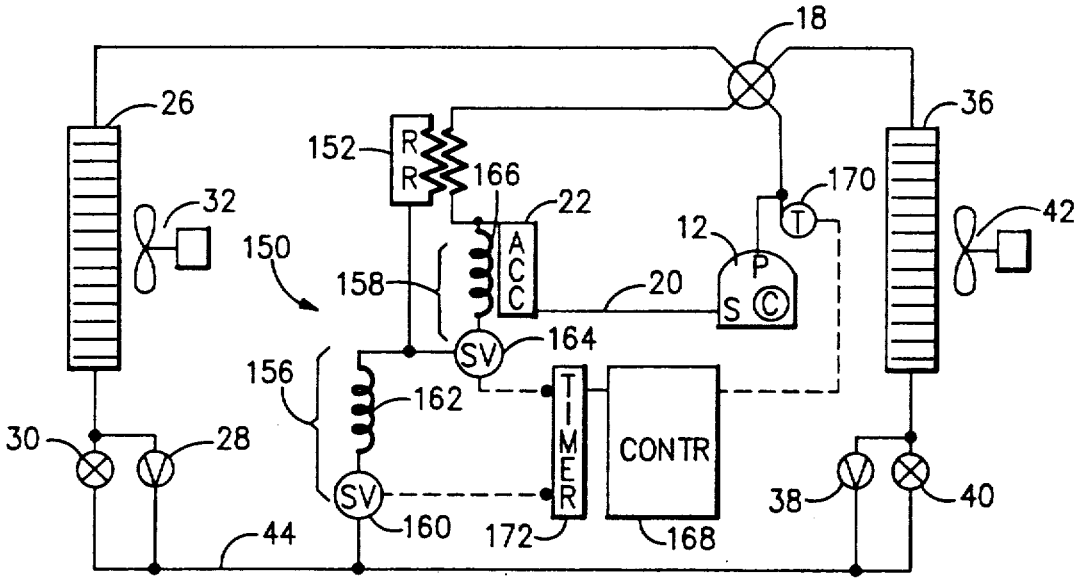
FIG. 2 is a schematic circuit diagram of a heat pump system according to another embodiment of this invention.

A second embodiment is shown in FIG. 2, in which like elements are identified with similar reference numbers, and a detailed description of such elements is omitted. Reference numbers of the charge adjustment arrangement elements are generally raised by 100. In this embodiment control of refrigerant charge is effected based not on discrete temperatures $T_1$ and $T_2$, but rather as a function of discharge temperatures that can vary depending on indoor temperature, outdoor temperature, discharge and suction pressure, and other possible operating parameters.

Here a charge adjustment arrangement 150 includes a refrigerant reservoir 152 with an inlet branch 156 comprised of a solenoid valve 160 and a flow restrictor 162 and a discharge branch 158 comprised of a solenoid valve 164 and a flow restrictor 166.

A microprocessor based controller circuit 168 has an input terminal connected to a temperature sensor 170 in thermal contact with the discharge port P of the compressor 12, and outputs coupled to actuate the solenoid valve 160 and 164. A time delay circuit 172 can be incorporated to prevent the charge adjustment arrangement from being actuated for some predetermined time after start up of the compressor 12 to permit the system to stabilize.

The arrangement of FIG. 2 permits a different pair of temperatures to control withdrawal and addition of refrigerant fluid for heating and for cooling; or to change the value of the two threshold temperatures as a function of one or more of outdoor temperature, indoor temperature, coil temperature, suction pressure, discharge pressure, etc.

As also shown in FIG. 2, the reservoir 152 includes a suction gas superheat exchanger 174 in which some heat is transferred between the refrigerant stored in the reservoir and the suction line 20. Also, the outlet port that connects the reservoir 52 or 152 to the branch 58 or 158 is at the bottom of the reservoir. Withdrawal of refrigerant from the bottom ensures that the reservoir does not become oil-clogged.

Figure 3:
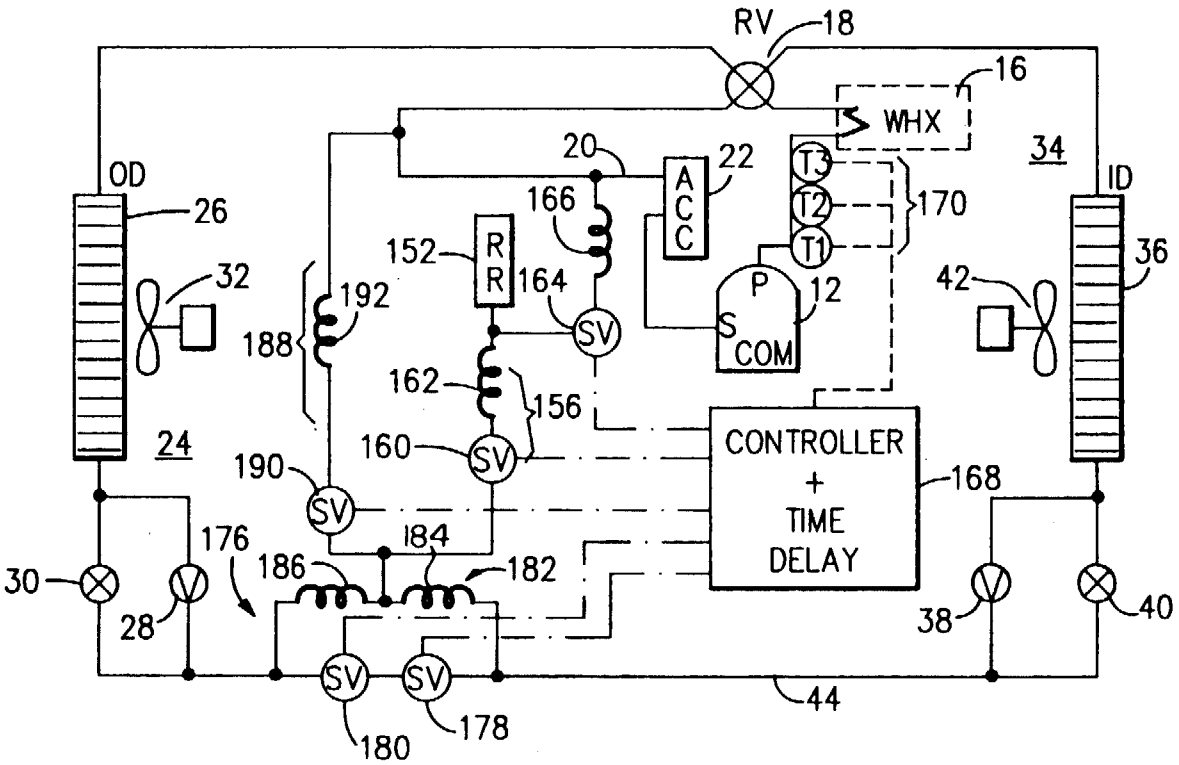
FIG. 3 is a schematic circuit diagram of an integrated heat pump and water heating system which also embodies this invention.

FIG. 3 shows the present invention as implemented in an integrated heat pump and hot water system capable of providing space heating, space cooling, and heating of water, with or without space heating or cooling. Here again, the elements that have been earlier described with reference to FIG. 1 or FIG. 2 are identified with the similar reference numbers, and a detailed description is omitted.

In this embodiment there is a water heat exchanger 16 interposed in the discharge line 14 between the compressor discharge port P and the reversing valve 18. The water heat exchanger 16 transfers heat from the compressed refrigerant to water which is then supplied to a domestic water heating tank (not shown). The integrated heat pump system includes a selective flow restriction arrangement 176 interposed in the liquid refrigerant line 44 between the outdoor and indoor heat exchangers 24, 34. In this embodiment there is a main, unrestricted flow branch comprised of a pair of solenoid valves 178, 180 arranged back to back and a restricted flow branch 182 comprised of a pair of flow restrictors 184, 186 connected in series and bridging the solenoid valves 178, 180. A quenching branch line 188 comprised of another solenoid valve 190 and a flow restrictor 192 in series connects between the junction of the flow restrictors 184, 186 and the suction line 20 in advance of the accumulator 22. The purpose and function of the selective flow restriction arrangement 176 and the branch line 188, which is to adjust the effective compressor capacity for water heating without space heating or cooling, is discussed in detail in my co-pending U.S. patent application No. 07/699,919, which is incorporated herein by reference.

In this embodiment the inlet branch 156 that supplies the refrigerant reservoir 152 is joined to the junction of the two flow restrictors 184, 186. In other embodiments the inlet branch could be connected elsewhere, e.g., to the junction of the two solenoid valves 178 and 180.

The controller 168 has outputs to control the solenoid valves 178, 180 and 190, in addition to the two solenoid valves 160 and 164. The temperature sensor 170 is coupled to the controller to actuate the solenoid valves 160 and 164 at temperatures $T_1$ and $T_2$ for room heating and cooling modes, as discussed previously. However for a dedicated water heating mode, i.e. water heating only without space heating or cooling, a third discharge line temperature $T_3$ above temperature $T_2$ may be employed to actuate the valve 164 so as to provide additional discharge superheat to the water heat exchanger.

While this invention has been described in detail with reference to selected preferred embodiments, it should be recognized that the invention is not limited to those precise embodiments. Rather, many modifications and variations would present themselves to those of skill in the art without departing from the scope and spirit of this invention, as defined in the appended claims.

What is claimed is:

1. A heat pump system capable of providing cooling to an indoor space and heating of said indoor space, comprising a refrigerant compressor having a discharge port from which compressed refrigerant vapor is discharged and a suction port to which the refrigerant is returned as low pressure vapor;

an outdoor heat exchanger which includes a heat exchanger coil having first and second refrigerant ports and an outdoor expansion device coupled to the second refrigerant port of the associated coil;

an indoor heat exchanger which includes a heat exchanger coil having first and second refrigerant ports and an indoor expansion device coupled to the second refrigerant port of the associated coil;

a reversing valve having a first port coupled by a pressure line to the discharge port of said compressor; a second port coupled by a suction line to the suction port of said compressor to supply the low pressure refrigerant vapor thereto; and third and fourth ports respectively connected to the first ports of the heat exchanger coils of the outdoor and indoor heat exchangers; said reversing valve having a heating position in which the compressed refrigerant is supplied to the indoor coil and the low pressure vapor is returned from the outdoor coil, and a cooling position in which the compressed refrigerant is supplied to the outdoor coil and the low pressure vapor is returned from the indoor coil;

a condensed refrigerant line that connects the indoor and outdoor heat exchanger coils for supplying condensed refrigerant from one of said heat exchanger coils to the expansion device of the other heat exchanger; and charge adjustment means to change the amount of active charge of said refrigerant in said system in response to changes in operating conditions of the heat pump system, said charge adjustment means including a refrigerant reservoir, a first branch connected to the condensed refrigerant line and to the refrigerant reservoir, said first branch including a first valve and a flow regulating element in series, a second branch connected to the suction line and the refrigerant reservoir, said second branch including a second valve and a flow regulating element in series, sensor means coupled to the pressure line to detect the thermal energy of the compressed refrigerant discharged from said compressor, and means for actuating said first and second valves in dependence on the detected level of thermal energy of said compressed refrigerant so that refrigerant is transferred from said condensed refrigerant line to said reservoir when said thermal energy is below a predetermined level, and so the refrigerant is transferred from said reservoir to said suction line when said thermal energy is above a predetermined level.

2. The heat pump system according to claim 1 wherein said sensor means includes a thermostat which is coupled to said first and second valves to open said first valve when the temperature of the pressure line is below a first predetermined temperature and to open the second valve when the temperature of the pressure line is above a second predetermined temperature.

3. The heat pump system according to claim 2 wherein said second temperature is higher than said first temperature.

4. The heat pump system according to claim 1 wherein said sensor means includes a temperature sensor in thermal communication with said pressure line and said means for actuating is operative to actuate said first and second valves at temperatures which are different depending on whether said reversing valve is set to place the system in a heating mode or a cooling mode.

5. The heat pump system according to claim 1 wherein said controller means includes a delay timer which is operative to hold said first and second valves closed for a predetermined period following start up of said compressor.

6. The heat pump system according to claim 1 and further comprising a water heat exchanger interposed in said pressure line in advance of said reversing valve for transferring heat from the compressed refrigerant to water in the water heat exchanger for heating said water, and said heat pump system having modes for heating water while providing space heating or cooling and for heating water without providing space heating or cooling, and wherein said sensor means detects the temperature of the compressed refrigerant in said pressure line between said compressor and said water heat exchanger, and wherein said means for actuating is operative to actuate said first and second valves at temperatures which are different respectively depending on whether said heat pump system is in a mode providing space heating, a mode providing space cooling, or a mode providing water heating without space heating or cooling.

* * * * *